United States Patent [19]

Beckman et al.

[11] Patent Number: 4,519,751

[45] Date of Patent: May 28, 1985

[54] PIEZOELECTRIC PUMP WITH INTERNAL LOAD SENSOR

[75] Inventors: John B. Beckman, Cedartown; Martin J. Blickstein, Austell, both of Ga.

[73] Assignee: The Abet Group, Rome, Ga.

[21] Appl. No.: 450,338

[22] Filed: Dec. 16, 1982

[51] Int. Cl.[3] ..... F04B 17/00

[52] U.S. Cl. ..... 417/322

[58] Field of Search ..... 73/DIG. 4; 324/158 MG, 324/158 R, 56; 417/322, 63, 44, 45, 12, 566; 137/859

[56] References Cited

U.S. PATENT DOCUMENTS

| | | | |
|---|---|---|---|
| 2,362,750 | 11/1944 | Hayward | 417/505 X |
| 3,107,630 | 10/1963 | Johnson et al. . | |
| 3,150,592 | 9/1964 | Stec . | |
| 3,215,078 | 11/1965 | Stec . | |
| 3,270,672 | 9/1966 | Haines et al. . | |
| 3,361,067 | 1/1968 | Webb . | |
| 3,401,719 | 9/1968 | Rosser | 137/859 X |
| 3,465,732 | 9/1969 | Kattchee . | |
| 3,599,657 | 8/1971 | Maldavs | 137/859 X |
| 3,677,092 | 7/1972 | Guarino | 417/63 X |
| 3,753,426 | 8/1973 | Lilley . | |
| 3,768,931 | 10/1973 | Willis, Jr. . | |
| 3,840,758 | 10/1974 | Zoltan . | |
| 3,963,380 | 6/1976 | Thomas, Jr. et al. . | |
| 4,182,356 | 1/1980 | Woodford | 137/859 X |
| 4,231,287 | 11/1980 | Smiley . | |
| 4,344,743 | 8/1982 | Bessman et al. | 417/505 X |
| 4,370,098 | 1/1983 | McClain et al. | 417/45 X |
| 4,432,699 | 2/1984 | Beckman et al. | 417/474 X |

FOREIGN PATENT DOCUMENTS

| | | | |
|---|---|---|---|
| 83102 | 7/1978 | Japan | 417/322 |

*Primary Examiner*—Edward K. Look

*Attorney, Agent, or Firm*—Jerry W. Mills; Gregory M. Howison; Nina L. Medlock

[57] ABSTRACT

A piezoelectric pump includes a hollow cylindrical piezoelectric crystal (12) with end bells (22) and (24) on either end defining a pump chamber (14). A resilient diaphram (32) with an offset orifice (34) provides afferent valving action and a resilient diaphram (44) with an offset orifice (46) provides efferent valving action. Connecting leads (52) and (54) allow a voltage source (56) to be periodically connected to the crystal (12) by a switch (62). A resistor (64) is disposed between one pole of the switch (62) and the connecting lead (54) to allow decay of the charge on the crystal (12). By sensing the voltage on the lead (52) during relaxation of the crystal 12, the internal load can be monitored to provide an indication of the pumping operation. Automatic monitoring is provided by a computer (104).

3 Claims, 8 Drawing Figures

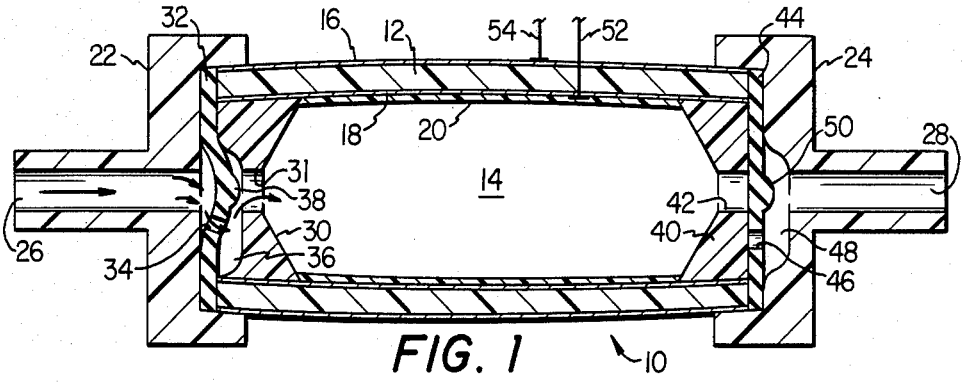
FIG. 1
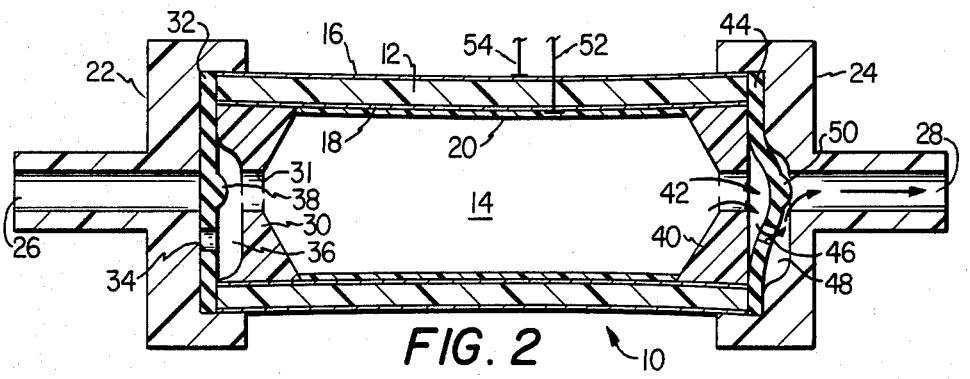
FIG. 2
FIG. 4
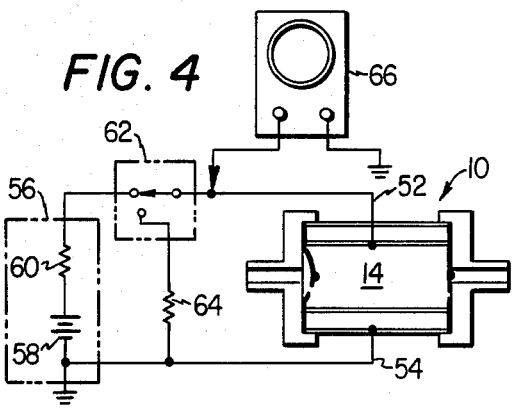
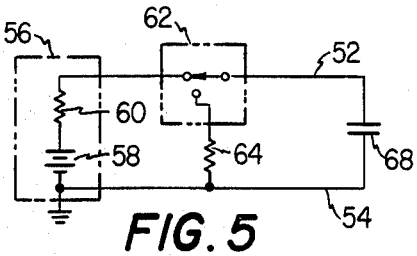
FIG. 5
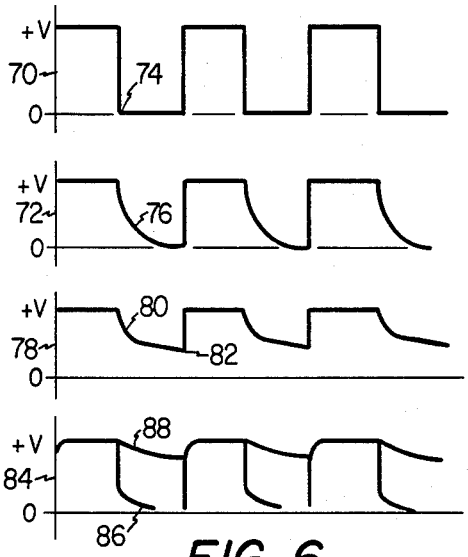
FIG. 6

PIEZOELECTRIC PUMP WITH INTERNAL LOAD SENSOR

TECNICAL FIELD

The present invention is related in general to pumping units and, more particularly, to piezoelectric pumping units with internal load sensors.

BACKGROUND OF THE INVENTION

Piezoelectric pumps have been developed to provide miniaturized high-reliability pumps that inherently have very low operational noise levels. In hybridized piezoelectric pumps, the pump chamber is normally fabricated of a piezoelectric wall that expands d contracts in response to an externally-applied voltage potential. The valving action is normally supplied by mechanical ball check valves that, when activated, generate a rhythmic noise that is synchronized with the pumping action. An example of a piezoelectric pump utilizing check valves is shown in U.S. Pat. No. 3,150,592 issued to C. L. Stec. The Stec Patent utilizes the back pressure of the fluid to close the check valves, and, as such, this closing generates a certain degree of noise. This noise, although substantially reduced over piston pumps, is still present to a lesser degree. Moreover, ball check valves have tendencies to clog or otherwise become inoperative over a period of time when used with viscous fluids, such as ultravenous fluids and the like.

Reliable fluid delivery is normally accomplished by placing external sensors about the pump to determine if fluid flow has stopped or been substantially diminished. These external sensors are bulky and inconvenient to use. In addition, they are separate from the pump itself, thus requiring a need for moving the sensors every time the pump is moved.

In view of the above described disadvantages, there exists a need for a pump that is reliable and is adaptable for applications such as pumping intravenous fluids. In addition, it is desirable that the pump have a self contained monitoring system with even further reduced noise levels.

SUMMARY OF THE INVENTION

The present invention described and disclosed herein comprises a method and apparatus for piezoelectrically pumping a fluid and monitoring the operation of the piezoelectric pump. The apparatus comprises a piezoelectric pump for providing an expanding and contracting volume and an activation circuit for activating the pump to expand and contract. A first valve is disposed adjacent the piezoelectric pump for allowing only afferent flow and a second valve is also disposed adjacent the pump for allowing only efferent flow. A sensing circuit is provided for sensing the piezoelectric affect that results from the internal load on the pump.

In another embodiment of the invention, the piezoelectric pump includes a hollow piezoelectric cylinder with inner and outer cylindrical surfaces and a first and second end cap attached to either end of the cylinder. An inner electrode is attached to the inner cylindrical surface and an outer electrode is attached to the outer cylindrical surface. The inner and outer electrodes are then attached to the activating circuit. In yet another embodiment of the present invention, the first and second valves are comprised of resilient diaphragms that are attached around the periphery to a support member. The support member has an orifice therethrough and the diaphragm also has an orifice therethrough which is offset from the orifice through the support member. The orifice in the diaphragm abuts the surface of the support member when the diaphragm is relaxed and the orifice is distended from the support member when pressurized on the side of the diaphragm adjacent the support member.

In a further embodiment of the present invention, an apparatus is provided for monitoring the operation of a piezoelectric pump. The apparatus includes a voltage source having one polarity connected to one electrode of the pump and a circuit for periodically connecting and disconnecting the other polarity of the voltage source to the other electrode of the pump which activates the pump. A sensing circuit senses the internal load of the pump by monitoring the passive piezoelectric effect on the pump when the pump is disconnected from the voltage source. This allows the sensing circuit to sense the decay time during relaxation of the pump when the stored charge is decaying.

In a yet further embodiment of the present invention, a method is provided for piezoelectrically pumping fluid. The method comprises expanding a piezoelectric pumping chamber and then allowing the pumping chamber to relax. Flow through the pumping chamber is restricted to one direction only and the internal load of the pumping chamber is sensed while the chamber is relaxing. Other aspects of the present invention will become apparent hereinafter.

BRIEF DESCRIPTION OF THE DRAWINGS

For a more complete understanding of the present invention and the advantages thereof, reference is now made to the following description taken in conjunction with the accompanying drawings in which:

FIG. 1 illustrates a cross-sectional diagram of the pump of the present invention in the afferent mode;

FIG. 2 illustrates a cross-sectional view of the pump of the present invention in the efferent mode;

FIG. 4 illustrates a basic schematic diagram of the sensing circuit for sensing the operation of the pump of the present invention;

FIG. 5 illustrates an equivalent schematic diagram of the circuit of FIG. 4;

FIG. 6 illustrates the timing diagrams for the circuit of FIG. 4; and

DETAILED DESCRIPTION OF THE INVENTION

Figure 3A:
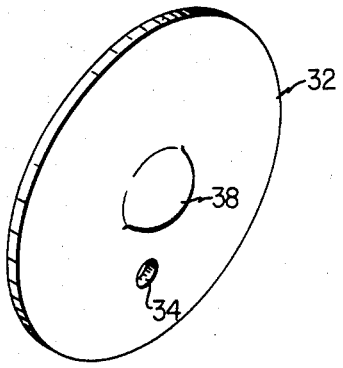
FIG. 3 illustrates the membrane valves.

Referring now to FIG. 1, there is shown a cross-sectional diagram of a piezoelectric pump 10. A cylindrical piezoelectric crystal 12 provides the outer surface of a pump chamber 14. An outer electrode 16 is disposed adjacent the exterior surface of the piezoelectric crystal 12 and an inner electrode 18 is disposed on the interior surface of the piezoelectric crystal 12. An insulating layer 20 is disposed on the surface of the inner electrode 18 opposite the piezoelectric crystal 12 to provide both insulation of the pump chamber from the inner electrode 18 and to provide a protective layer for the inner electrode 18. The insulating layer 20 is fabricated from teflon or some substance that provides both electrical insulation in addition to being nonreactive to the pumping fluids.

An end bell 22 and an end bell 24 are disposed at either end of the cylindrical piezoelectric crystal 12 to totally enclose the pump chamber 14. The end bell 22 has an inlet port 26 and the end bell 24 has an outlet port 28. The inlet port 26 allows fluid to flow into the pump chamber 14 and the outlet port 28 allows fluid to flow out of the pump chamber 14. The end bells 22 and 24 are fabricated of molded plastic and are utilized basically to arrange for attaching necessary tubing and sealing the overall assembly to form the pump chamber 14.

A circular inlet insert 30 is disposed interior to the piezoelectric crystal 12 at one end thereof. The insert 30 has a circular shape with an orifice 31 disposed in the middle thereof to allow fluid to flow therethrough. A resilient diaphragm 32 abuts the inner surface of the end bell 22 and is disposed between the longitudinal end of the cylindrical piezoelectric crystal 12 and the interior surface of the end bell 22. The end bell 22 and the longitudinal end of the cylindrical piezoelectric crystal 12 are operable to secure the peripheral edge of the resilient diaphragm 32.

The resilient diaphragm 32 has an orifice 34 disposed through the surface thereof and oriented at a position that is offset from the longitudinal access of the inlet port 26. The orifice 34 is operable to allow fluid to flow from the inlet port 26 through the orifice 31 in the insert 30 when the diaphragm 32 is distended, as will be described hereinbelow. A developed recess chamber allows the diaphragm 32 to distend when there is either a positive pressure on the inlet port 26 or a negative pressure in the pump chamber 14. When there is an equalization in pressure, the diaphragm 32 relaxes and the orifice 34 abuts against the interior surface of the end bell 22, thereby preventing fluid from flowing from the inlet port 26 through the orifice 34. A "dimple" 38 is disposed on the surface of the resilient diaphragm 32 in the middle thereof to form a thickened area that effectively decreases the elasticity of the diaphragm at this point. This decreased elasticity at the center thereof allows the center of the diaphragm 32 to remain somewhat immobile with relation to the rest of the diaphragm. This permits the diaphragm 32 upon removal of a pressure differential to relax against the interior surface of the end bell 22 thus closing off any fluid passageway through the orifice 34.

A circular outlet insert 40 is disposed in the other end of the circular piezoelectric crystal 12 and has an orifice 42 disposed in the center thereof to allow efferent flow from the pump chamber 14 through the outlet port 28. A resilient diaphragm 44 identical to the diaphragm 32 abuts the interior surface of the end bell 24 and is disposed between the longitudinal end of the piezoeletric crystal 12 and the interior surface of the end bell 24. The longitudinal end of the piezoelectric crystal 12 and the interior surface of the end bell 24 are operable to secure the diaghragm 44 around the peripheral edge thereof. The surface of the resilient diaphragm 44 opposite the interior surface of the end bell 24 abuts the exterior surface of the outlet insert 40.

The resilient diaphragm 44 has an orifice 46 disposed through the surface thereof offset from the longitudinal axis of the orifice 42 in the outlet insert 40. A developed recess chamber 48 disposed on the interior surface of the end bell 24 allows the diaphragm 44 to distend outward from the insert 40 towards the outlet port 28 thereby allowing fluid to flow from the pump chamber 14 through the orifice 46 and out of the outlet port 28. A dimple 50 is disposed on the surface of the diaphragm 44 opposite to the exterior surface of the outlet insert 40 and is identical in operation to the dimple 38.

A connecting lead 52 is attached to the inner electrode 18 and a connecting lead 54 is connected to the outer electrode 16. The connected leads 52 and 54 allow application of a voltage potential across the electrodes 16 and 18. The piezoelectric crystal 12 is "poled" in the radial direction and, when experiencing a voltage in the poling direction, the diameter of the cylinder increases in the radial direction and, when the reverse voltage is applied, the diameter of the cylinder decreases.

The pump 10 illustrated in FIG. 1 depicts a piezoelectric crystal 12 in the expanded condition thereby increasing the volumetric capacity of the pump chamber 14. When a potential is applied in the poling direction of the piezoelectric crystal 12, the diameter increases and creates a negative pressure within the pump chamber 14. This negative pressure is translated to the surface of the resilient diaphragm 32 through the orifice 31. This negative pressure creates a pressure differential between the pressure within the inlet port 26 an the recess chamber 36 thereby causing the diaphragm 32 to distend inward to the recess chamber 36. As the diaphragm 32 distends, the orifice 34 is pulled away from the interior surface of the end bell 22. This then allows fluid to flow from the inlet port 26 through the orifice 34 into the recess chamber 36. As the pressure is equalized between the inlet port 26 and the pump chamber 14, the resilient membrane 32 relaxes back to its original position due to the elasticity of the material that the membrane is fabricated from. When the membrane has relaxed to a position that allows the orifice 34 to again abut the interior surface of the end bell 22, the fluid passageway from the inlet port 26 to the recess chamber 36 is sealed off. This is an important aspect of the present invention in that a positive pressure within the pump chamber 14 is not required to seal off the fluid passageway and in addition, there is no "snap action" due to the closing of the valve. The only mechanical movement is the stretching of the membrane 32 which also creates heat loss.

Referring now to FIG. 2, there is shown a cross-sectional diagram of the pump 10 with the piezoelectric crystal 12 in the contracted position, that is, with a voltage polarity applied to the connecting leads 52 and 54 opposite the poling direction. The contraction of the piezoelectric crystal 12 causes the volumetric capacity of the pumping chamber 14 to decrease, thus increasing the pressure therein. This positive pressure creates a pressure differential between the differential chamber 36 and the inlet port 26 thus forcing the diaphragm 32 to abut the interior surface of the end bell 22. In addition, this positive pressure is exerted against the surface of the diaphragm 44 causing it to distend into the recess chamber 48. This distention of the diaphragm 44 causes the orifice 46 to move away from the surface of the outlet insert 40 into the recess chamber 48, thus allowing fluid to flow from the pump chamber 14 through the orifice 46 and into the recess chamber 48. The fluid then flows through the outlet port 28. When the pressure is equalized between the pump chamber 14 and the recess chamber 48, the elasticity of the diaphragm 44 forces relaxation to abut the orifice 46 against the surface of the outlet insert 40 to close off the fluid passageway. The polarity on the connected lead 52 and 54 is then reversed and the piezoelectric crystal 12 expands, as shown in FIG. 1.

Although the operation of the pump 10 described above is for an active pumping action, the pump 10 also functions in a passive mode. A piezoelectric crystal is operable to generate a voltage when an external force causes either expansion or contraction thereof. For example, when an external force is applied in the direction of the original poling force, the piezoelectric crystal produces a positive voltage across the electrodes, with the opposite polarity produced by reversing the force. In this sense, and an important aspect of the present invention, the cylindrical piezoelectric crystal is a sensor in that it detects the presence of a force and the direction of that force within the pump chamber 14.

Figure 3B:
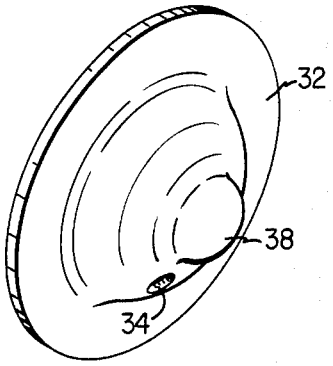

Referring now to FIGS. 3*a* and 3*b*, there is illustrated a prospective view of the diaphragm 32 of FIGS. 1 and 2. FIG. 3*a* depicts the diaphragm in the relaxed mode and FIG. 3*b* depicts the diaphragm 32 in the distended mode in response to pressure indicated by the arrows. From FIG. 3*b*, it is apparent that the dimple 38 is operable to reduce the amount of stretching directly beneath the dimple such that stretching of the diaphragm is restricted to areas radially about the dimple 38. In this manner, the orifice 34 is more easily distended from abutting a surface directly beneath it.

The dimple 38 is disposed on the surface of the diaphram 32 such that it is directly covering the inlet port 26 on the pump 10 of FIGS. 1 and 2. When the diaphram 32 distends, only the portion of the diaphram 32 within the radial portion containing the orifice 34 undergoes substantial stretching. This results from the decreased elasticity of the dimple 38 which reduces localized stretching. In addition, the periphery of the diaphram 32 is secured between the innner surface of the end bell 22 and the inlet insert 30. Therefore, only an annular portion of the diaphram 32 stretches.

Referring now to FIG. 4, there is illustrated a simplified circuit for both activating the pumping action of pump 10, and also sensing the internal load within the chamber 14. A D.C. voltage source 56 comprised of a battery 58 and its internal resistance 60 has the positive end thereof connected to one input of a single pole double throw switch 62 and the other end thereof connected to the connecting lead 54. The output of switch 62 is connected to the connecting lead 52. In the activated position, the battery is connected to the connecting lead 52. A resistor 64 has one end connected to the second input of switch 62, and the other end connected to the connecting lead 54.

An oscilloscope 66 has the sensing lead thereof connected to the connecting lead 52 and the ground lead thereof connected to ground, which is also connected to the negative pole of the battery 58. In this manner, the scope 66 can indicate a trace of the wave form that is present across the connecting leads 52 and 54.

Referring now to FIG. 5, there is illustrated a simplified schematic for the circuit in FIG. 4. The piezoelectric crystal 12 of FIGS. 1 and 2 is represented by an equivalent capacitor 68. When the switch 62 is positioned as shown in FIG. 5, voltage is applied across the capacitor 68. The capacitor 68 charges up according to the relationship defined by the time constant resulting from the combination of the internal resistance 60 of the voltage source 56 and the capacitance of the capacitor 68. Since the internal resistance 60 is relatively small, this time constant is minimal.

When the switch 62 is switched to connect the output of the voltage source 56 to resistor 64, the stored charge within the capacitor 68 returns to ground through the resistor 64. This also is subject to the time constant that is a function of both the resistance of the resistor 64 and the capacitance of the capacitor 68. By adjusting the value of the resistor 64, this time constant can also be adjusted.

Referring now to FIG. 6, there are illustrated four wave forms describing the operation of the pump 10 of the present invention which illustrate voltage amplitude as a function of time. The voltage varies from a minimum of 0 volts to a maximum of +V. A waveform 70 depicts the periodic operation of the switch 62 with no pump connected, that is, with the connecting lead 52 detached. It should be understood that the switch 62 can incorporate an astable driven electronic switch that alternates between connection to the connecting lead 52 and resistor 64. The waveform 72 depicts the operation of the pump 10 with a minimal internal load in the pump chamber 14 such as air and for a given repetition rate. In the present application, the pump 10 is ony subjected to either a positive voltage or zero voltage such that the pump will only, for example, expand. When the voltage is initially increased to +V, the pressure within the pump chamber 14 decreases to a negative pressure, thereby distending the diaphragm 32 to provide an afferent passageway into the pump chamber 14.

When the switch 62 is connected to resistor 64, as depicted by a point 74 on the waveform 70, there is no longer current being supplied to the combination of the resistor 64 and the capacitor 68 from the voltage source 56. Since there is no current flowing from the voltage source 56 through the resistor 64, current flows from the capacitor 68 through the resistor 64 thereby discharging the capacitor 68. This is shown by a curve 76 on the waveform 72. Depending upon the duration of time that elapses between the opening of the switch 62 and the closing thereof, the decay of the voltage on the capacitor 68 will continue until it reaches a zero potential. However, this decay is a function of the value of the resistor 64 and the capacitor 68 and also the internal load within the pump chamber 14. As the voltage decreases on the capacitor 68, representing the decrease in voltage on the piezoelectric crystal 12, the crystal 12 undergoes a radial contraction to its original position. It should be understood that during the time that the positive voltage was applied, the pressure within the pump chamber 14 equilibrates allowing the diaphragm 32 to relax thereby reducing the afferent flow.

At the moment in time represented by the point 74 wherein the voltage source 56 is removed from the connecting lead 52, the diaphragm 32 is essentially relaxed. However, it should be understood that the duration of time that the piezoelectric crystal 12 is expanded is variable and may be changed depending upon the particular application. At this point, the piezoelectric crystal 12 begins to relax and, in doing so, incurs a force due to the fluid contained within the pump chamber 14. This force will increase as a function of the contraction of the piezoelectric crystal 12 and the tension of the diaphragm 44. When the internal force increases to a positive value, the diaphragm 44 distends to create a passageway through the outlet port 28 to relieve the pressure within the pump chamber 14. However, there remains a force internal to the chamber 14 that is a function of the contraction force of the piezoelectric crystal 12, the opposing elastic force due to the diaphragm 44 and the size of the orifice 46. The size of the orifice 46 determines the rate of decrease of force in the chamber 14. As described above, this force creates an opposing positive voltage which tends to alter the decay time for the curve 76 of the waveform 72. It alters it in a manner such that a longer duration of time is required for the waveform 76 to decay to a zero potential.

A waveform 78 depicts the operation of the pump 10 with a more viscous fluid in the pump chamber 14 than utilized with respect to the waveform 72. As in the case with the waveform 72, the waveform 78 depicts the presence of a positive voltage +V for a duration of time sufficient to allow the pump chamber 14 to fill with the fluid and increase the pressure therein. When the voltage source 56 is removed from the connecting lead 52, the piezoelectric crystal 12 begins to relax due to decaying of the voltage thereon through the resistor 64. Since the fluid within the pump chamber 14 is more viscous, it is less compressible than air and incurs a larger amount of friction in passing through the orifice 46. This results in an increased internal load as a function of time since the fluid does not compress as easily as air and the pressure within the pump 14 is not released as rapidly through the orifice 46 as was the air in the example given with reference to the waveform 72. This is apparent from a curve 80 on the waveform 78 that shows a longer decay time constant.

At a point 82, the switch 62 is again returned to the position connecting the voltage source 56 to the connecting lead 52 to thereby cause expansion of the crystal 12. This expansion is quite rapid since the internal resistance 60 is very small. The result is that the piezoelectric crystal 12 is not allowed to relax to its normal position before again expanding to allow afferent flow to the pump chamber 14.

A waveform 84 depicts the operation of the pump 10 with either faulty afferent flow or faulty efferent flow. When the afferent flow is faulty, it is due possibly to a faulty diaphragm 32 or a clogged inlet port 26. It may also be due to a clog in a line connecting an external fluid source to the inlet port 26. A curve 86 depicts faulty afferent flow the situation after the switch 62 has disconnected the voltage source 56 from the connecting lead 52. Since there is no afferent flow, expansion of the pump chamber 14 results in a continual negative pressure which is maintained until the voltage source 56 is removed from the connecting lead 52. At this point, the piezoelectric crystal 12 experiences a negative force due to the negative pressure within the pump chamber 14 which actually generates a negative voltage thereon and the voltage across the connecting leads 52 and 54 decreases vary rapidly to the ground potential.

If the efferent flow is faulty, this can be due to a faulty membrane 44 or a clog in the fluid path to the outlet port 28. The situation is depicted by a curve 88 on the waveform 84. During expansion of the pump chamber 14, afferent flow causes the pressure therein to equalize and, upon contraction, the pressure therein increases. Since efferent flow cannot pass through the inlet port 26 as described above with reference to the description of the diaphram 32, a restriction in the outlet port 28 prevents any efferent flow from the pump chamber 14, thus increasing the internal load within the pump chamber 14. This internal load is maintained by the incompressible fluid and restricts contraction of the piezoelectric crystal 12 thereby retaining a positive voltage between the connecting leads 52 and 54. This is apparent from the curve 88 that illustrates a very slow decay time between the time that the switch removes the voltage source 56 from the connecting lead 52 and the time that it is reconnected.

In the circuit of FIG. 4, a waveform observed on the oscilloscope 66 is operable to provide an indication of the internal operation of the pump. This indication is obtained directly from the characteristics of the piezoelectric crystal 12 itself. There is no requirement for external sensors attached either to the pump itself or to the external connecting lines. Nor does monitoring the operation of the pump require measuring fluid flow in any way. The only requirement is that the voltage between the connecting leads 52 and 54 be monitored during the time that the switch 62 removes the voltage source 56 from the connecting lead 52 and the time that the voltage source 56 is reconnected. This can then be compared with a threshold or a predetermined level to sound an alarm if an oscilloscope is not utilized.

Figure 7:
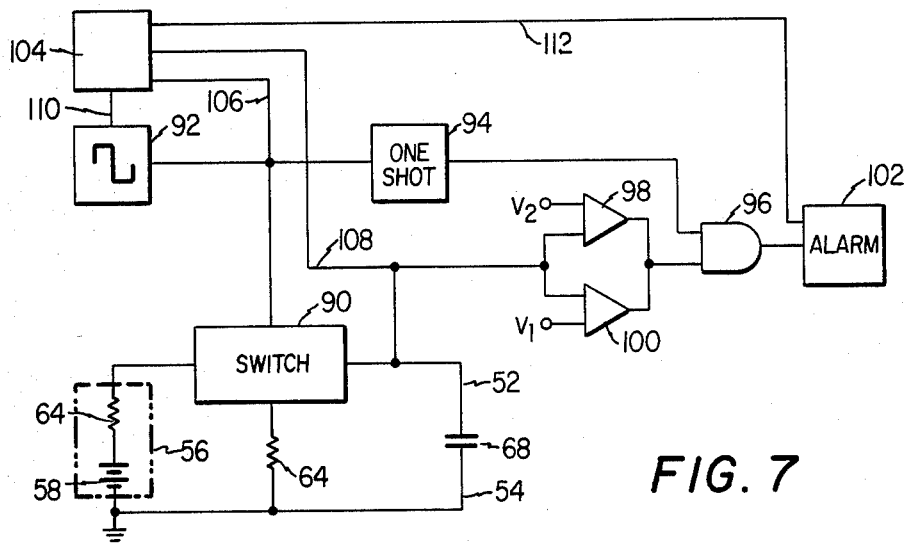
FIG. 7 illustrates an exemplary embodiment of the sensing circuit.

Referring now to FIG. 7, there is illustrated an alternate embodiment of the circuit of FIG. 5. The switch 62 is replaced with a solid state switch or relay 90 that is operable to switch at the desired rate for the pump 10. The switch 90 is driven by an astable multivibrator 92 that can incorporate any general operational amplifier circuit. An example of this can be found in Linear Applications, National Semiconductor Corp., Vol. 1 (1973) Page AN31-6. The output of the multivibrator 92 is input to a one shot 94 that is of the type 74LS123 manufactured by Texas Instruments, Incorporated. The one shot 94 is adjusted to output a sample pulse at a selected point in time between the moment that the switch 90 removes the voltage source 56 from the connectiong lead 52 and the moment that the voltage source is reconnected. The one shot 94 is operable to control one input of an AND gate 96.

A comparator 98 and a comparator 100 both have one input lead thereof connected to the connecting lead 52 and the outputs thereof connected to the other input of the AND gate 98. The comparators 98 and 100 are of the type LM311 manufactured by National Semiconductors Corp. and are connected to provide a window comparator. The threshold input of the comparator 98 is connected to a voltage $V_1$ and the comparator 100 has its threshold input connected to a threshold voltage $V_2$.

By varying the threshold voltages $V_1$ and $V_2$, the comparators 98 and 100 are operable to only output a signal when the decay time of the voltage between the connecting leads 52 and 54 is either below one threshold or above another threshold. The one shot 94 is operable in conjunction with the comparators 98 and 100 to sample this voltage only at a specific time. At this specific time, the output of the AND gate 96 triggers an alarm 102. The thresholds $V_1$ and $V_2$ can be adjusted to provide for tolerances and loads experienced within the pump chamber 14 in a normal operating environment.

By sampling the voltage on the connecting lead 52 during relaxation of the crystal 12, the pump parameters which can be indicated by a symbiotic pumpsensor relationship are:

(1) the total volume can be electronically calculated by the wave shape for each stroke;
(2) the total volume for a given period of time can be calculated electronically by multiplying the time by the number of pulses per second;
(3) the presence of a compressible gas such as air can determine an alarm by detecting excessively rapid decay time;

(4) problems such as valve malfunction can be detected and electronically analyzed by sensing decay time; and (5) pump rate can be electronically calculated by measuring the time between disconnecting and reconnecting the switch.

To provide further capability for the monitoring of the piezoelectric pump, there is provided an automatic monitoring system through use of a computer 104 that monitors the operation of the piezoelectric pump and also controls the operation of the piezoelectric pump. The computer 104 is connected to the output of the astable multivibrator 92 to a sensing line 106 for sensing the frequency thereof. The computer 104 is connected to the astable multivibrator 92 through a control line 110 and is operable to both control and sense the astable multivibrator 92 and, through this control, control the operation of the switch 90. By sensing the rate of switching that is output by the astable multivibrator 92 and the relaxation rate from the capacitor 68, the operation of the pump, as described above, can be monitored. The computer 104 can perform the functions 1–5 described above that automatically monitor the operation of the piezoelectric pump. The alarm 102 is connected by a control line 112 such that the computer 104 can override the operation of the alarm 102 and activate it. It should be understood that the computer 104 can be any microprocessor-based unit such as those utilizing the Z-80 microprocessor manufactured by Intel Corp. and the associated circuitry supplied therewith.

In summary, a piezoelectric switch is provided with a resilient membrane valving action to coordinate with the expansion of a cylindrical piezoelectric tube to provide the pumping action. A monitoring circuit is provided to utilize the inherent parameters of the piezoelectric material and monitor the internal load of the piezoelectric pump. By sensing the voltage across the electrodes of the piezoelectric material, the operation of the pump is monitored and an optional alarm sounded when a faulty operation is detected.

Although the preferred embodiment has been described in detail, it should be understood that various changes, substitutions and alterations can be made therein without departing from the spirit and scope of the invention as defined by the appended claims.

What we claim is:

1. A pump comprising:

piezoelectric pumping means for providing an expanding and contracting volume;

activating means for activating said pumping means to expand and contract;

first valving means disposed adjacent to said piezoelectric pumping means for allowing only afferent flow and second valving means disposed adjacent to said pumping means for allowing only efferent flow;

said first and second valving means comprising:

a supporting member having an inlet opening;

a resilient diaphragm attached around the periphery to said supporting member and having an orifice through the surface thereof, said orifice offset from the inlet opening of said supporting member, said orifice abutting the surface of said supporting member when said diaphragm is relaxed and said orifice distended from said supporting member when pressurized on the side of said diaphragm adjacent said supporting member, said resilient diaphragm also comprising a decreased area of elasticity on the surface of said diaphragm locally disposed adjacent said inlet opening in the relaxed state of said diaphragm; and sensing means for piezoelectrically sensing the piezoelectric effect resulting from the internal load on said pumping means.

2. A pump comprising:

piezoelectric pumping means for providing an expanding and contracting volume having an afferent orifice and an efferent orifice for fluids there through;

activating means for activating said pumping means to expand and contract;

efferent valving means disposed adjacent the efferent orifice and afferent valving means disposed adjacent the afferent orifice, said afferent and efferent valving means having:

a support member, and a resilient diaphragm attached around the periphery of said support member, said resilient diaphragm having an orifice adjacent said support member and offset from the orifice in said pumping means, said resilient diaphragm operable under pressure to distend the orifice therein away from said support member to allow fluid to flow therethrough and relax as pressure decreases, said diaphragm also comprising a decreased area of elasticity on its surface locally disposed adjacent the orifice in said pumping means in the relaxed state of said diaphragm.

3. A pump comprising:

a hollow piezoelectric cylinder having an inner cylindrical surface and an outer cylindrical surface;

an inner electrode attached to said inner cylindrical surface;

an outer electrode attached to said outer cylindrical surface;

first directional means disposed at one end of said cylinder to only permit efferent flow into said cylinder and second directional means disposed at the other end of said cylinder to only permit afferent flow;

said first and second directional means comprising:

a supporting member having an orifice disposed through the surface thereof for fluid flow therethrough;

a resilient diaphragm disposed adjacent the surface of said supporting member and having an orifice disposed through the surface thereof for fluid flow therethrough and also having a thickened area adjacent the orifice in said support member, said thickened area having a lower elasticity than the remaining portion of said diaphragm, the periphery of said diaphragm affixed to said support member;

the orifice through said resilient diaphragm offset from the orifice in said support member such that when said resilient membrane abuts said support member, fluid flow is inhibited;

said diaphragm operable to distend from the surface of said support member in response to fluid pressure on the surface of said diaphragm adjacent to said support member wherein fluid flows through the orifice in both said member and said diaphragm.

* * * * *

UNITED STATES PATENT AND TRADEMARK OFFICE

CERTIFICATE OF CORRECTION

PATENT NO. : 4,519,751

DATED : May 28, 1985

INVENTOR(S) : John B. Beckman, Martin J. Blickstein

It is certified that error appears in the above—identified patent and that said Letters Patent is hereby corrected as shown below:

Col. 1, line 15, "expands d contracts"
should be --expands and contracts--.

Col. 7, line 51, "decreases vary rapidly"
should be --decreases very rapidly--.

Signed and Sealed this

*Twenty-eighth* Day of *January 1986*

[SEAL]

*Attest:*

DONALD J. QUIGG

*Attesting Officer*

*Commissioner of Patents and Trademarks*